US005814438A

United States Patent [19]

Vishwakarma et al.

[11] Patent Number: 5,814,438

[45] Date of Patent: Sep. 29, 1998

[54] BENZOTRIAZOLE-BASED NOVEL UV ABSORBERS AND PHOTOGRAPHIC ELEMENTS CONTAINING THEM

[75] Inventors: Lal C. Vishwakarma; Glenn M. Brown, both of Rochester; Barry F. Briffa, Leicester, all of N.Y.

[73] Assignee: Eastman Kodak Company, Rochester, N.Y.

[21] Appl. No.: 801,599

[22] Filed: Feb. 13, 1997

Related U.S. Application Data

[63] Continuation-in-part of Ser. No. 624,328, Mar. 29, 1996, abandoned.

[51] Int. Cl.[6] ..... G03C 1/815

[52] U.S. Cl. ..... 430/512; 430/507; 430/523

[58] Field of Search ..... 430/512, 507, 430/523

[56] References Cited

U.S. PATENT DOCUMENTS

| | | | |
|---|---|---|---|
| 3,253,921 | 5/1966 | Sawdy | 96/73 |
| 3,533,794 | 10/1970 | Ohi et al. | 96/84 |
| 4,096,242 | 6/1978 | Strobel | 424/59 |
| 4,518,686 | 5/1985 | Sasaki et al. | 430/512 |
| 4,853,471 | 8/1989 | Rody et al. | 548/261 |
| 4,865,957 | 9/1989 | Sakai et al. | 430/505 |
| 4,891,396 | 1/1990 | Avar et al. | 524/91 |
| 4,973,701 | 11/1990 | Winter et al. | 548/260 |
| 4,973,702 | 11/1990 | Rody et al. | 548/261 |
| 4,975,360 | 12/1990 | Sasaki et al. | 430/512 |
| 4,992,358 | 2/1991 | Sasaki et al. | 430/512 |
| 4,996,326 | 2/1991 | Leppard et al. | 548/261 |
| 5,032,498 | 7/1991 | Rody et al. | 430/512 |
| 5,233,047 | 8/1993 | MacLeay et al. | 548/260 |
| 5,250,698 | 10/1993 | Falk et al. | 548/260 |

FOREIGN PATENT DOCUMENTS

| | | | |
|---|---|---|---|
| 0 031 302 | 7/1981 | European Pat. Off. . | |
| 0243199 | 10/1987 | European Pat. Off. . | |
| 288 249 | 3/1991 | Germany | G03C 1/06 |
| 42 29 233 | 3/1993 | Germany | G03C 1/825 |
| 50-159484 | 12/1975 | Japan . | |
| 3236390 | 10/1991 | Japan | C07D 487/04 |
| 408 033 | 9/1966 | Switzerland | C07D 55/04 |

OTHER PUBLICATIONS

P. Tschopp, Research Disclosure 22217, Use of UV–Absorbers, Oct. 1982, p. 327.

P. Tschopp, Research Disclosure 22519, Use of UV–Absorbers, Jan. 1983, pp. 6–7.

H.Kanzig, Research Disclosure 27832, Liquid UV–Absorbers for Photographic Materials, Jun. 1987, pp. 379–380.

Research Disclosure 29617, Dispersing Agents for Liquid UV–Absorbers Used in Photographic Materials , Dec. 1988, pp. 948–949.

Research Disclosure 30370, New Method for the Incorporation of Liquid UV–Absorbers in Photographic Materials.

*Primary Examiner*—Thorl Chea

*Attorney, Agent, or Firm*—Edith A. Rice

[57] ABSTRACT

An ultraviolet absorbing compound of formula (I) below, and photographic elements containing such a compound as an ultraviolet absorber:

(I)

wherein:

$R_1$–$R_4$ independently is a hydrogen atom, a halogen atom such as fluoro, chloro, bromo, iodo or a combination thereof; a carbalkoxy group having at least one asymmetric carbon or asymmetric silicon atom; an alkoxy group having at least one asymmetric carbon or asymmetric silicon atom, with the proviso that $R_2$ or $R_3$, or both $R_2$ and $R_3$ are other than hydrogen;

A* is a group having a carbon atom directly attached to 2'-hydroxyphenyl ring at the 5'-position which contains at least one asymmetric carbon atom or an asymmetric silicon atom, and;

wherein the ultraviolet absorbing compound of formula (I) is a mixture of two enantiomers about the asymmetric carbon or silicon atom of A*.

10 Claims, 3 Drawing Sheets

BENZOTRIAZOLE-BASED NOVEL UV ABSORBERS AND PHOTOGRAPHIC ELEMENTS CONTAINING THEM

This application is a continuation-in-part of application Ser. No. 08/624,328 filed Mar. 29, 1996, now abandoned, the entire disclosures of which are incorporated herein by reference.

FIELD OF THE INVENTION

This invention relates to novel benzotriazole-based UV absorbing compounds, and to photographic elements containing such compounds.

BACKGROUND

Typical photographic elements use silver halide emulsions, the silver halide having a native sensitivity to ultraviolet radiation. Ultraviolet radiation ("UV") as used in this application means light having a wavelength of 300–400 nm. Such UV sensitivity is usually undesirable in that it produces an image on the photographic element which is not visible to the human eye. Furthermore, the image dyes in color photographs are known to fade due to action of UV light. Also, other organic molecules, such as unused color forming couplers in the emulsion layers and optical brighteners in the paper support, degrade due to action of UV light and generate undesirable color stains on the finished photographs. Therefore, photographic elements typically contain a UV absorbing compound (sometimes referred to simply as a "UV absorber"). Another function of UV absorbers is to prevent the formation of undesirable patterns caused by electrostatic discharge in silver halide photographic materials. In general, UV absorbers impart light stability to organic molecules in various products which are susceptible to degrade as a result of the action of UV.

Generally, an effective UV absorber should have its peak absorption above a wavelength of 320 nm. The absorption peak may be at a longer wavelength, as long as absorption drops off sufficiently as it approaches the visible range (approximately 400 to 700 nm) so that no visible color is shown by the compound. In addition, to be effective, a UV absorber should not show any tailing of its spectral absorption envelope beyond 400 nm as it starts absorbing blue light which then makes the UV compound look visibly yellow. Any visible yellowing is highly undesirable in the unexposed area of color paper in silver halide photography.

UV absorbers of the benzotriazole class for photographic and other applications are well known. In accordance with the importance of such applications of these compounds, a large number of patents and research disclosures have been published. They include 2'-hydroxyphenyl benzotriazoles with various substituents on the hydroxyphenyl ring and the benzotriazole ring. Particularly variations in 3',5'-alkyl substituents in the hydroxyphenyl ring have been of major importance, primarily because such starting phenols are readily available for synthesis of 2'-hydroxyphenyl benzotriazole compounds. Compounds of the foregoing type are disclosed, for example, in Research Disclosures Item Nos. 22,217 (October 1982), 22,519 (January 1983), 27,832 (June 1987), 29,617 (December 1988), 30,370 (July 1989); in foreign patents such as DD 288,249, CH 408,033, EP 0 031 302, DE U.S. Pat. No. 4,229,233, JP 5-0159484, JP 3-200788, and JP 3-236390, and in U.S. Pat. Nos. 3,253,921, 3,533,794, 4,096,242, 4,891,396, 4,996,326, 5,233,047, and 5,250,698. These patents and Research Disclosures mostly have focused on uses of these compounds in non-photographic applications such as cosmetic preparations, sun screening lotions, polymeric materials, paints, varnishes, pigments or dyes and to methods of producing those compounds.

U.S. Pat. Nos. 4,996,326, 4,853,471, 4,973,702 disclose 2'-hydroxyphenyl benzotriazoles which may contain a 5'-substituent comprising a branched or straight chain alkyl group. U.S. Pat. Nos. 4,975,360, 4,973,701 and 4,996,326 all disclose such compounds in photographic elements. In all these patents, only branched and unbranched alkyl substituents have been cited without any special reference to them as containing asymmetric carbon atom(s) where branching occurs. The beneficial influence of asymmetric carbon containing benzotriazole compounds in a photographic environment has not been recognized. Also, the effect of appropriate combination of substituents in the benzotriazole ring and 2'-hydroxyphenyl ring on spectral absorption hue, a major factor influencing photographic properties particularly increase or decrease in visible yellowing, has not been recognized. Although U.S. Pat. Nos. 4,518,686, 4,865,957, 4,992,358 and 5,032,498 disclose photographic elements containing 2'-hydroxyphenyl benzotriazole compounds, desirable attributes as described above are lacking.

Commercial UV absorbers which are currently used in photographic products include those of formula (II-A) and (II-B) below:

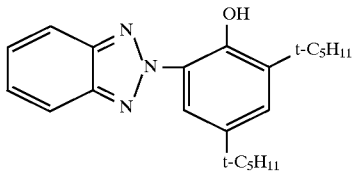

(II-A)

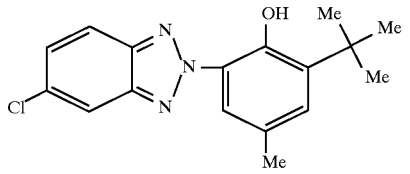

(II-B)

However, compounds (II-A) and (II-B) have a propensity to crystallize out during cold storage of a dispersion of them and their intrinsic light stability is inferior.

Problem to be Solved by the Invention

It is therefore desirable to have other UV absorbing compounds suitable for photographic uses, which are relatively stable in a photographic environment, and in particular have no tendency to crystallize out at ordinary temperatures at which photographic elements are used and/or stored, which have at least similar extinction coefficients to that of (II-A)/(II-B)(collectively referred to as Comparative C-1), and which have a good UV absorption spectrum offering appropriate hue for photographic uses without causing visible yellowing.

SUMMARY OF THE INVENTION

Most of the UV absorbers given in the prior art, for example a compound of formula (III), (which is disclosed in U.S. Pat. No. 4,992,358):

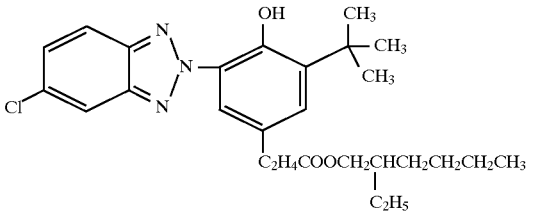

(III)

have a 3'-alkyl substituent in combination with a 5-halogen substituent which together make the compounds of the prior art look visibly yellow. If both these substituents or only 5-halogen substituent in formula (III) are removed, the absorption spectrum of the resulting UV absorbing compound becomes undesirably too hypsochromic loosing its UV absorbing efficacy on the longer wavelength side of the spectrum.

We have now discovered that in order to attain appropriate hue it is found necessary to replace the 3'-substituent with a hydrogen atom while keeping halogen or other suitable substituents at 5- or 5- and 6-position(s). Additionally, in order to improve the intrinsic light stability and to improve the solubility of such compounds in hydrophobic organic solvents, it also becomes necessary to incorporate asymmetric carbon or asymmetric silicon atom(s) preferably in the 5'-substituent.

The present invention comprises ultraviolet absorbing compounds of formula (I) below, and photographic elements containing them:

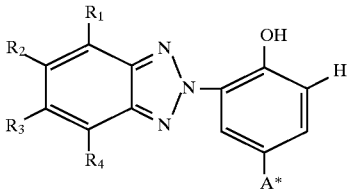

(I)

wherein:

$R_1$–$R_4$ independently is a hydrogen atom, a halogen atom such as fluoro, chloro, bromo, iodo or a combination thereof; a carbalkoxy group having at least one asymmetric carbon or asymmetric silicon atom; an alkoxy group having at least one asymmetric carbon or asymmetric silicon atom, with the proviso that $R_2$ or $R_3$, or both $R_2$ and $R_3$ are other than hydrogen;

A* is a group having a carbon atom directly attached to 2'-hydroxyphenyl ring at the 5'-position which contains at least one asymmetric carbon atom or an asymmetric silicon atom, and;

wherein the ultraviolet absorbing compound of formula (I) is a mixture of two enantiomers about the asymmetric carbon or asymmetric silicon of A*.

UV absorbing compounds of formula (I) have a wavelength of maximum absorption ("λmax") which is desirable in the longer UV region (336–380 nm), have a sharp dropping absorption profile at wavelengths slightly shorter than 400 nm making them useful with known fluorescent brighteners while not looking visibly yellow, are relatively stable in the environment of a photographic element, do not readily crystallize in photographic elements, and have desirable extinction coefficients.

Advantageous Effect of the Invention

It has now been found that the novel UV absorbers of the present invention have a good hue for use in photographic elements without causing visible yellowing. Further, they have an extremely high solubility in high-boiling hydrophobic organic solvents regardless of their physical state, have enhanced intrinsic light stability, have no tendency of crystallization in dispersions or in photographic coatings, and have improved hue causing no visible yellowing and are therefore superior to the products of the state of the art in the photographic field. In some cases the UV absorbers are actually liquid and can be employed in a color photographic material without high-boiling solvents.

DETAILED DESCRIPTION OF THE INVENTION

Figure 1:
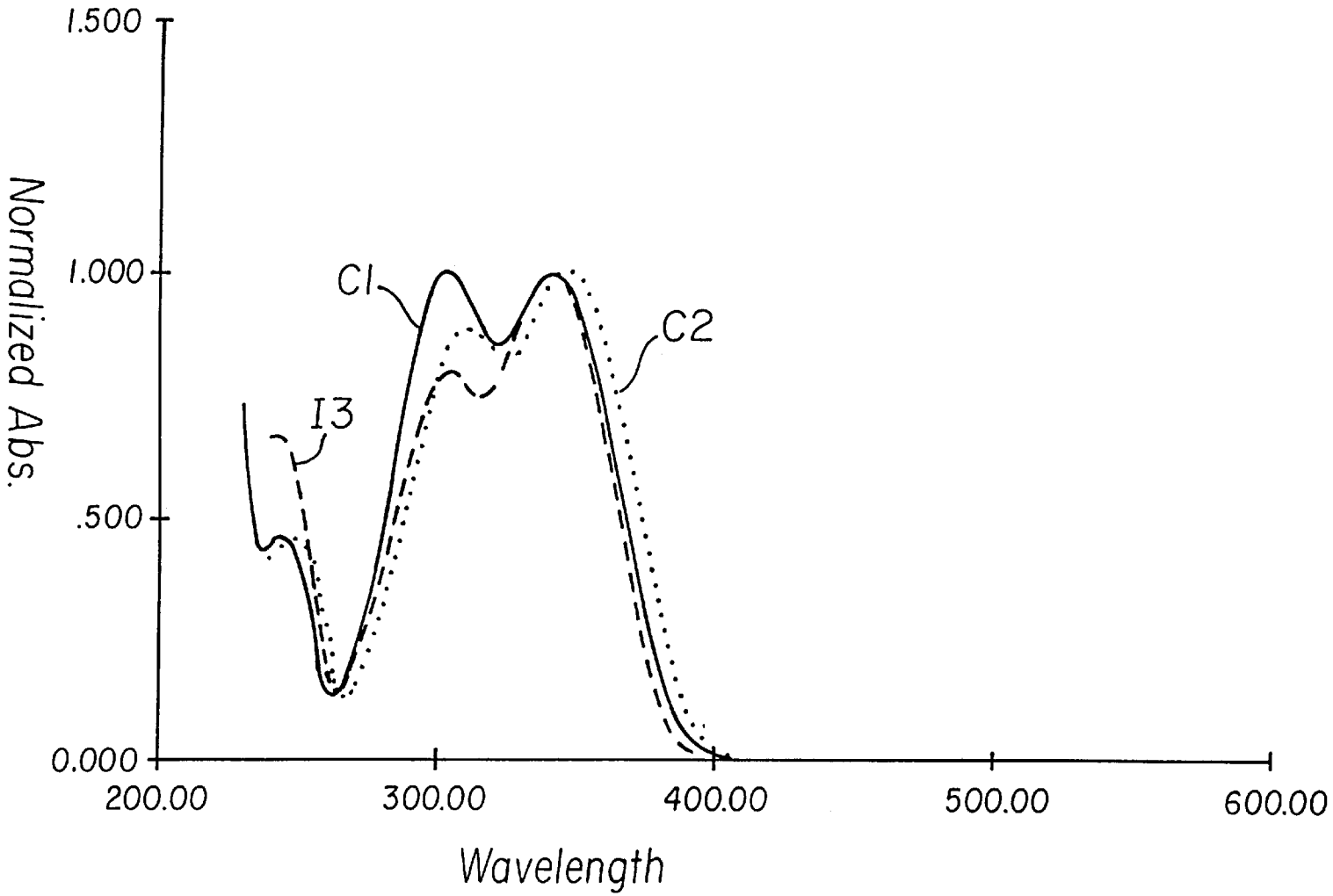
FIG. 1 shows the normalized absorption spectra in methanolic solution for a mixture of comparative control compounds (II-A) and (II-B) (solid line, C-1), for a compound of formula (III) (dotted line, C-2), as well as for an invention compound (dashed line, I-3)

In the present application, reference to ultraviolet or UV in relation to the present invention refers to the wavelength range of 300 to 400 nm unless the contrary is indicated. Additionally, reference to "under", "above", "below", "upper", "lower" or the like terms in relation to layer structure of a photographic element, is meant the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support.

Further, reference to any chemical "group" (such as alkyl group, aryl group, heteroaryl group, and the like) includes the possibility of it being both substituted or unsubstituted (for example, alkyl group and aryl group include substituted and unsubstituted alkyl and substituted and unsubstituted aryl, respectively). Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition.

As is well known, enantiomers have identical structural formulas except they are non-superimposable mirror images of one another. Further, in reference to enantiomeric mixtures, proportions are in mole ratios. When reference is made in this application to the ultraviolet absorbing compound of formula (I) being a mixture of two enantiomers about the asymmetric carbon or silicon of A*, this refers to a mixture of the two optical isomers about the racemic carbon or silicon of A* with R and S stereochemical configurations.

In compounds of formula (I), the 3'-substituent is a hydrogen atom. At least one of the $R_2$ or $R_3$ and more preferably $R_2$ and $R_3$, is a halogen atom, preferably a chloro group, a 1 to 8 carbon atom alkoxy group or 1 to 12 carbon atom carbalkoxy group or a combination thereof, preferably possessing an asymmetric carbon atom or an asymmetric silicon atom.

A* is preferably an alkyl* group of 4 to 18 carbon atoms having at least one asymmetric carbon atom or an asymmetric silicon atom; or a group of the formula:

$$—(CH_2)_p—G—R_5^*,$$

wherein:

$R_5^*$ is a branched or unbranched alkyl group having at least one asymmetric carbon atom or asymmetric silicon atom; p is 1 to 18; and G is —C(O)O—, —OC(O)—, —S—, —SO—, —$SO_2$— or —$CON(R)_6$—, where $R_6$ is a branched or unbranched alkyl, optionally containing an asymmetric carbon atom or asymmetric silicon atom.

Preferably, none of the carbon atoms of A* is unsaturated, except when A* contains a carbonyl carbon atom or an aryl or heteroaryl group.

However, the compound of formula (I) can have further racemic carbon centers. When $R_1$, $R_2$, $R_3$ or $R_4$ also contains an asymmetric carbon (or any other substituent also contains an asymmetric carbon), such that there are two or more asymmetric carbons in the compound, diastereomers can then be formed. This means that the UV absorbing compound of formula (I) could then have more than one pair of enantiomers. However, the compound should preferably have a 60/40 to 40/60 (more preferably 50/50) ratio of at least two enantiomers (although it can have, for example a 60/40 to 40/60 ratio of enantiomers in each of two sets of enantiomers).

It should be noted that UV absorbing compounds are specifically contemplated which are of formula (I) and all the specific examples below. In such cases, the 5'-position of the hydroxyphenyl ring is substituted with any of those substituents described above as A*. Examples of compounds of the present invention are shown below.

TABLE 1

| $R_1$ | $R_2$ | $R_3$ | $R_4$ | A* | Remark |
|---|---|---|---|---|---|
| H | H | Cl | H | sec-Butyl | UV-1 |
| H | Cl | Cl | H | sec-Butyl | UV-2 |
| H | F | H | H | sec-butyl | UV-3 |
| H | F | F | H | sec-Butyl | UV-4 |
| H | H | Cl | H | 2-Ethylhexyl | UV-5 |
| H | H | Cl | H | $CH_2COO$-sec-butyl | UV-6 |
| H | H | Cl | H | $CH_2CH_2COO$-sec-butyl | UV-7 |
| H | H | Cl | H | $CH_2COO$-2-ethylhexyl | UV-8 |
| H | H | Cl | H | $CH_2CH_2COO$-2-ethylhexyl | UV-9 |
| H | Cl | Cl | H | $CH_2CH_2COO$-sec-butyl | UV-10 |
| H | Cl | Cl | H | $CH_2CH_2COO$-2-ethylbexyl | UV-11 |
| H | H | Cl | H | $CH_2OCO$-sec-butyl | UV-12 |
| H | Cl | Cl | H | $CH_2OCO$-sec-butyl | UV-13 |
| H | H | Cl | H | $CH_2CH_2OCO$-sec-butyl | UV-14 |
| H | Cl | Cl | H | $CH_2CH_2OCO$-sec-butyl | UV-15 |
| H | H | Cl | H | $CH_2CH_2OCO$-2-ethylhexyl | UV-16 |
| H | Cl | Cl | H | $CH_2CH_2OCO$-2-ethylhexyl | UV-17 |
| H | H | Cl | H | $CH_2CH_2CH_2OCO$-sec-butyl | UV-18 |
| H | Cl | Cl | H | $CH_2CH_2CH_2OCO$-sec-butyl | UV-19 |
| H | H | Cl | H | $CH_2CH_2CH_2OCO$-2-ethylhexyl | UV-20 |
| H | Cl | Cl | H | $CH_2CH_2CH_2OCO$-2-ethylhexyl | UV-21 |
| H | H | $CH_3O$ | H | $CH_2CH_2CH_2OCO$-sec-butyl | UV-22 |
| H | Cl | $CH_3O$ | H | $CH_2CH_2CH_2OCO$-2-ethylhexyl | UV-23 |
| H | H | $CH_3O$ | H | $CH_2CH_2COO$-sec-butyl | UV-24 |

TABLE 1-continued

| $R_1$ | $R_2$ | $R_3$ | $R_4$ | A* | Remark |
|---|---|---|---|---|---|
| H | Cl | $CH_3O$ | H | $CH_2CH_2COO$-2-ethylhexyl | UV-25 |
| H | H | $CH_3OOC$ | H | $CH_2CH_2CH_2OCO$-sec-butyl | UV-26 |
| H | Cl | $CH_3OOOC$ | H | $CH_2CH_2CH_2OCO$-2-ethylhexyl | UV-27 |
| H | H | $CH_3OOC$ | H | $CH_2CH_2COO$-sec-butyl | UV-28 |
| H | Cl | $CH_3OOC$ | H | $CH_2CH_2COO$-2-ethylhexyl | UV-29 |

Intermediate compounds for making UV absorbing compounds of the present invention can be readily synthesized by condensing diazonium salts of o-nitroanilines such as 4-chloro-2-nitroaniline, 4,5-dichloro-2-nitroaniline, 4-methoxy-2-nitroaniline, 4-carboxy-2-nitroaniline with the corresponding phenols such as 4-sec-butyl phenol, 4-(2-ethylhexyl)phenol, 3-(4-hydroxyphenyl)-propionic acid, p-hydroxyphenyl acetic acid, 2-(4-hydroxyphenyl)ethanol, and 3-(4-hydroxyphenyl)propanol etc. Preparation of such azo dye intermediates are well known in the art, see for example Japanese Kokai Patent Application No. Sho 50[1975]-159484. The formation of a typical azo dye is illustrated by the following equation:

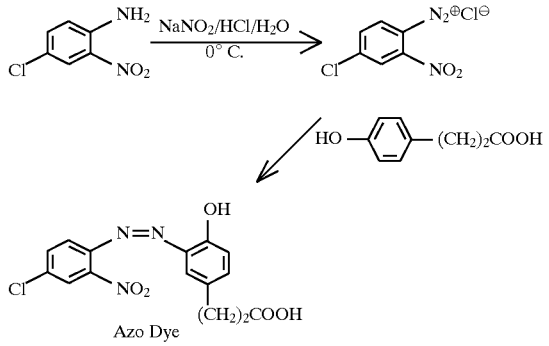

Such azo dye intermediates may be easily transformed into 2'-hydroxyphenylbenzotriazole UV absorbing chromophore by a catalytic hydrogenation procedure described in commonly assigned copending application Ser. No. 08/611,964, Filed on Mar. 7, 1996 (Attorney's Docket No. 73,347), the entire disclosures of which are incorporated herein by reference. A typical procedure given below illustrates this conversion.

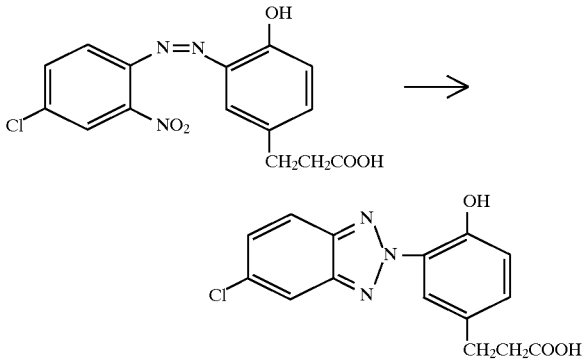

4-Chloro-2-nitro-2'-hydroxy-5'-(2-carboxyethyl) azobenzene (purity 65%) is made by a general procedure described in the Japanese Kokai Patent Application No. Sho 50[1975]-159484.

To a 4000 mL capacity stainless steel autoclave equipped with a stirrer, external heating jacket and internal heating and cooling coils are added 88.12 g (0.164 mole based on 65% purity) of 4-Chloro-2-nitro-2'-hydroxy-5'-(2-carboxyethyl)azobenzene of 65% purity, 4.4 g (dry weight) of (4% Pd/C+1% Pt/C) catalyst, 73.66 g (about 4 mole equivalent) of tert-butylamine, 99.75 g (about 3 mole equivalent) of 50% aqueous hypophosphorus acid and 3000 mL of methanol. The autoclave is purged with nitrogen gas and then hydrogen gas and then sealed and charged with hydrogen gas to a pressure of 53,000 $Kg/m^2$. The reaction is stirred at room temperature and at 53,000 $Kg/m^2$ pressure (recharging if necessary) for one hour. After one hour the temperature is raised to 50° C. and held at the same temperature and pressure for an additional 12 hours. Then the autoclave and its contents are cooled to 45°–47° C., removed and filtered through a Celite filter-aid pad to remove the catalyst. The catalyst and the residue on the filter pad are further washed with some methanol for complete recovery of the product. The organic solvents are removed on a rotary evaporator. The residue is diluted with about 2000 mL of brine (saturated aqueous sodium chloride solution) and treated with hydrochloric acid dropwise until the Congo Red Indicator paper turns blue. The brown crude solid was filtered on a sintered glass funnel, washed with cold water, and air-dried to obtain 76.16 g crude solid material of 5-chloro-2H-[2'-hydroxy-5'-(2-carboxyethyl) phenyl]benzotriazole. The HPLC assay of crude material shows 91% purity of the peak of the desired product appearing at a retention time of 14.54 min. After purifying by two recrystallizations from isopropanol/water mixture using decolorizing carbon, 47.94 g of white solid (yield 92%) is obtained. Its FD-mass spectral analysis shows molecular ion peak at m/e 317. It has a melting point of 169°–170° C. Its UV absorption spectrum in methanol shows $\lambda_{max}$ at 341 nm with a molar extinction coefficient of 15,100.

Analogously, 5-chloro-2H-[2'-hydroxy-5'-(3-hydroxypropyl)phenyl]benzotriazole, 5-chloro-2H-[2'-hydroxy-5'-(2-hydroxyethyl)phenyl]benzotriazole, and 5-chloro-2H-[2'-hydroxy-5'-(carboxymethyl)phenyl] benzotriazole are also synthesized.

Appropriately functionalized 2'-hydroxyphenyl benzotriazole intermediates compounds such as of formula (IV) and formula (V) are used to prepare comparative examples and examples of the present invention as well by an esterification method well known in the art.

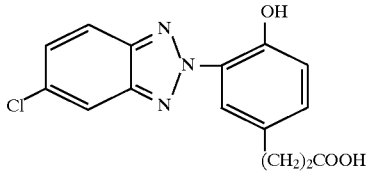

Formula (IV)

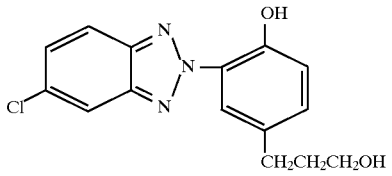

Formula (V)

Esterification of either of these is accomplished by condensing it with an appropriate alcohol or a carboxylic acid compound of interest in toluene in the presence of a catalytic amount of p-toluenesulfonic acid under azeotropic reflux. Etherification of the primary alcohol group of formula (V) is accomplished by reacting its disodium or dipotassium salt with an alkyl halide or an alkyl tosylate compound of interest in dimethylsulfoxide at room temperature.

Table 2 illustrates specific examples of the present invention.

TABLE 2

| Example | Compound | Solid or liquid | Remark |
|---|---|---|---|
| Comparison | 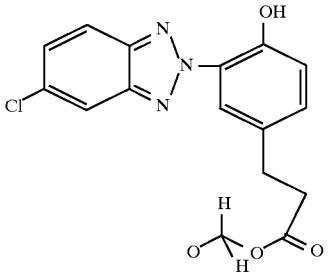 | Solid | C-3 |
| Comparison | 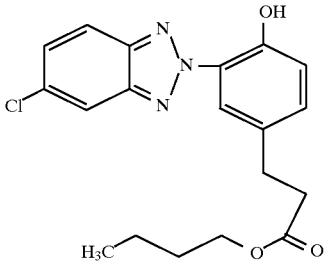 | Solid | C-4 |

TABLE 2-continued
| Example | Compound | Solid or liquid | Remark |
|---|---|---|---|
| Comparison | 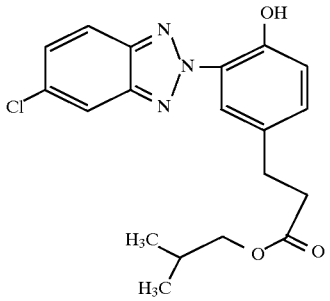 | Solid | C-5 |
| Comparison | 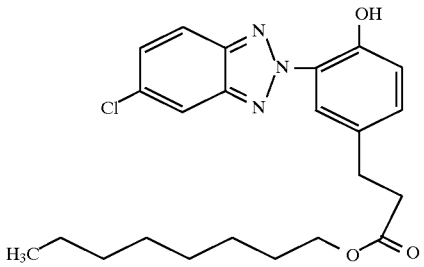 | Solid | C-6 |
| Comparison | 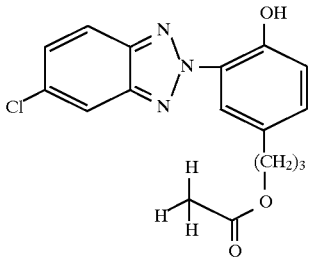 | Solid | C-7 |
| Comparison | 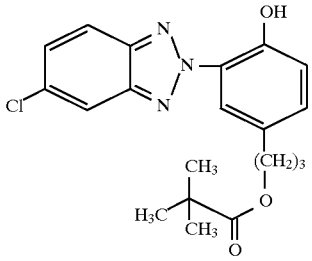 | Solid | C-8 |
| Comparison | 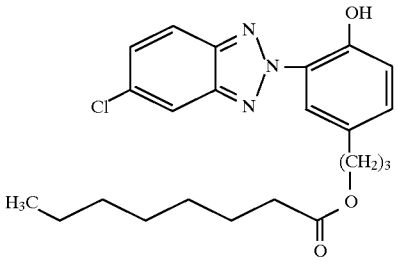 | Solid | C-9 |

TABLE 2-continued

| Example | Compound | Solid or liquid | Remark |
|---|---|---|---|
| Invention | 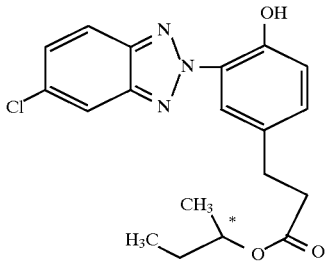 | Solid | I-1 |
| Invention | 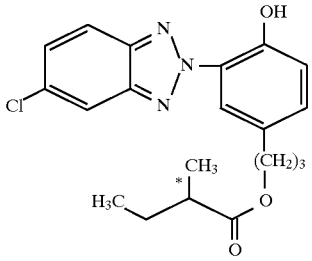 | Solid | I-2 |
| Invention | 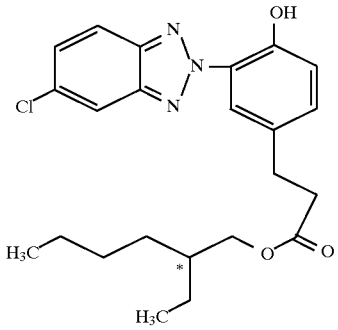 | Liquid | I-3 |
| Invention | 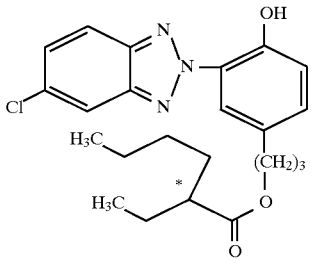 | Liquid | I-4 |

In Table 2 the (*) symbol in the compound indicates an asymmetric center in 5'-A* substituent of Formula (I).

Photographic elements according to the present invention will typically have at least one light sensitive silver halide emulsion layer and a non-light sensitive layer, with the ultraviolet absorbing compound of formula (I) being typically (but not necessarily) located in the non-light sensitive layer. More preferably, a photographic element of the present invention will have the non-light sensitive layer containing the ultraviolet absorbing compound located above all light sensitive layers. However, it is also contemplated that the ultraviolet absorbing compound can additionally be present in another layer, such as an interlayer (or even a light sensitive layer), particularly an interlayer located between red and green sensitive layers in an element having blue, green and red-sensitive layers coated in that order, on a support (particularly a paper support). Any layer of the photographic element in which the UV absorbing compounds of formula (I) are located will normally be a gel layer, and the UV absorbing compound may particularly be dispersed therein using a coupler solvent with or without additional ethyl acetate.

The UV absorbing compounds can be directly dispersed in the element or dispersed therein in droplets of a solvent dispersion. Alternatively, the UV absorbing compounds of formula (I) can be loaded into a polymer latex by themselves or with other compounds such as high boiling point organic solvents or monomeric UV absorbing compounds. "Loading" a polymer latex is generally described in U.S. Pat. No. 4,199,363 for example. Loading of a polymer latex is also described, for example, in U.S. Pat. Nos. 4,203,716, 4,214,047, 4,247,627, 4,497,929 and 4,608,424.

As described, UV absorbing compounds of the present invention are preferably used by themselves in a photographic element. However, they may be used in conjunction with other UV absorbing compounds if desired, such as other benzotriazole based UV absorbers. Examples of such conventional UV absorbing agents which can be used include: 2-(2-hydroxy-5-methylphenyl)-2H-benzotriazole, 2-(2-hydroxy-3,5-di-tert-butylphenyl)-2H-benzotriazole, 2-(2-hydroxy-3-tert-butyl-5-methylphenyl)-2H-benzotriazole, 2-(2-hydroxy-3,5-di-tert-butylphenyl)-5-chloro-2H-benzotriazole, 2-(2-hydroxy-3,5-di-tert-amylphenyl)-2H-benzotriazole, 2-(2-hydroxy-3,5-di(1,1-dimethylbenzyl)phenyl)-2H-benzotriazole, 2-(2-hydroxy-5-tert-octylphenyl)-2H-benzotriazole, and those described in U.S. Pat. No. 5,500,332 and commonly assigned allowed U.S. patent application Ser. No. 08/346,717 filed Nov. 30, 1994, the disclosures of which are incorporated herein by reference. Other types of UV absorbing agents such as p-hydroxybenzoates, phenyl esters of benzoic acid, salicylanilides and oxanilides, diketones, benzylidene malonate, esters of α-cyanocinnamic acid, and organic metal photo stabilizers, and others, as described in J. F. Rabek, *Photostabilization of Polymers, Principles and Applications,* Elsevier Science Publishers LTD, England, page 202–278 (1990).

The UV absorbing compound is incorporated into the photographic element (typically into a gelatin gel thereof) in an amount of between 0.2 $g/m^2$ to 10 $g/m^2$, and more preferably between 0.5 $g/m^2$ to 5.0 $g/m^2$. Furthermore, when incorporated as a solvent dispersion using a water immiscible organic solvent, the weight ratio of high boiling, water immiscible organic solvent to UV absorbing compound is preferably between 0.1 to 5.0 (that is, 0.1/1 to 5.0/1 of solvent/UV absorbing compound), and more preferably between 0.2 to 3.0 (that is, 0.2/1 to 3.0/1 of solvent/UV absorbing compound).

The UV absorbing compound of formula (I) is provided in any one or more of the layers (for example, a hydrophilic colloid layer such as a gelatin layer) of a photographic light-sensitive material (for example, a silver halide photographic light-sensitive material), such as a surface protective layer, an intermediate layer or a silver halide emulsion layer, and the like. For example, in photographic paper the UV absorbing compound of formula (I) with/without other UV absorbing compounds, may be positioned above and/or below the red sensitive layer (typically adjacent to it), the red sensitive layer typically being the uppermost light sensitive layer in color paper, or even completely or partially within the red sensitive layer. The UV absorbing compound is typically provided in a given layer of a photographic element by coating the hydrophilic colloid material containing gelatin or other polymeric binder onto a support or another previously coated layer forming part of the element.

The photographic elements made by the method of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND.

The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t >8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I,* Section I.B. (3) (page 503).

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as described in *Research Disclosure I,* Section IV (pages 510–511) and the references cited therein.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The present invention will be further described in the examples below.

Properties of the UV Absorbers of the Present Invention

Physical properties, including optical absorption profiles were measured for various of the compounds of the present invention, as well as comparative compounds, as shown in Table 3 below. In Table 3, $\lambda_{max}$ is the wavelength of maximum absorption (measured in MeOH as indicated in the Table), $\epsilon_{max}$ is the molar extinction coefficient, and the half bandwidth is the width of the absorption peak centered about $\lambda_{max}$ as measured at one-half the maximum absorption $\lambda_{max}$. All of the foregoing were measured in methanol. The percent yields of the products are not optimized.

TABLE 3

| Comp. No. | Example No. | % Yield | $\lambda_{max}$ (nm) (in MeOH) | $\epsilon_{max}$ ($\times 10^4$) | Half Band-width (nm) | Melting Point (°C.) |
|---|---|---|---|---|---|---|
| C-1 | (II-A)/ (II-B) (Control) 1 | — | 342 | 1.57 | 86 | Solid mixture |
| C-2 | 2 | — | 347 | 1.74 | 87 | Yellow looking liquid |

TABLE 3-continued

| Comp. No. | Example No. | % Yield | $\lambda_{max}$ (nm) (in MeOH) | $\epsilon_{max}$ ($\times 10^4$) | Half Band-width (nm) | Melting Point (°C.) |
|---|---|---|---|---|---|---|
| C-3 | 3 | 93 | 341 | 1.62 | 82 | 114–115 |
| C-4 | 4 | 80 | 341 | 1.58 | 82 | 88–89 |
| C-5 | 5 | 67 | 341 | 1.50 | 82 | 83–84 |
| C-6 | 6 | 99 | 341 | 1.64 | 81 | 75–76 |
| C-7 | 7 | 99 | 341 | 1.60 | 83 | 95–96 |
| C-8 | 8 | 98 | 341 | 1.58 | 83 | 100–101 |
| C-9 | 9 | 98 | 341 | 1.59 | 83 | 55–56 |
| I-1 | 10 | 51 | 341 | 1.61 | 82 | 74–75 |
| I-2 | 11 | 54 | 342 | 1.57 | 83 | 47–48 |
| I-3 | 12 | 98 | 341 | 1.64 | 82 | Liquid |
| I-4 | 13 | 98 | 341 | 1.60 | 83 | Liquid |

All the comparative examples, except C-2, are lacking asymmetric carbon atom center in the 5'-substituent, i.e., the 5'-substituents in comparative examples are represented by A and not A*. Examples C-6 and I-1 although have identical melting point, only C-6 is prone to crystallize out in the dispersion and/or coating.

Photographic Evaluation 1.45 g of UV absorber was dissolved at elevated temperature (50°–70° C.) in 480 mg of 1,4-cyclohexylenedimethylene bis(2-ethylhexanoate) and, if UV absorber was a solid at room temperature, an additional 4.35 g of ethyl acetate was used. This oil phase was added with high shear stirring to a 70° C. aqueous gelatin solution (containing per liter 40.1 g of gelatin and 31.0 mL of 10% aqueous Alkanol-XC) and passed five times through a colloid mill for adequate particle size reduction. The dispersion is inspected microscopically for general particle size and crystallinity, and coated about $0.108\times10^{-4}$ moles/m$^2$ on an acetate base in a two layer SOC-type format, allowed to dry and the coating is also inspected microscopically for crystallinity (See Table 4). Fresh coated spectral absorption data are recorded using a Perkin-Elmer Lambda 4C High Performance UV-VIS Spectrophotometer, and coated samples are HID (50 Klux Daylight; 315–700 nm) and HIS (50 Klux Sunshine; 280–700 nm) tested and compared to fresh data in order to obtain UV absorber intrinsic light stability information. (For HID and HIS explanation, see Lewis R. Koller, *Ultraviolet Radiation,* John Wiley & Sons, Inc., N.Y., N.Y., 1965).

Figure 2:
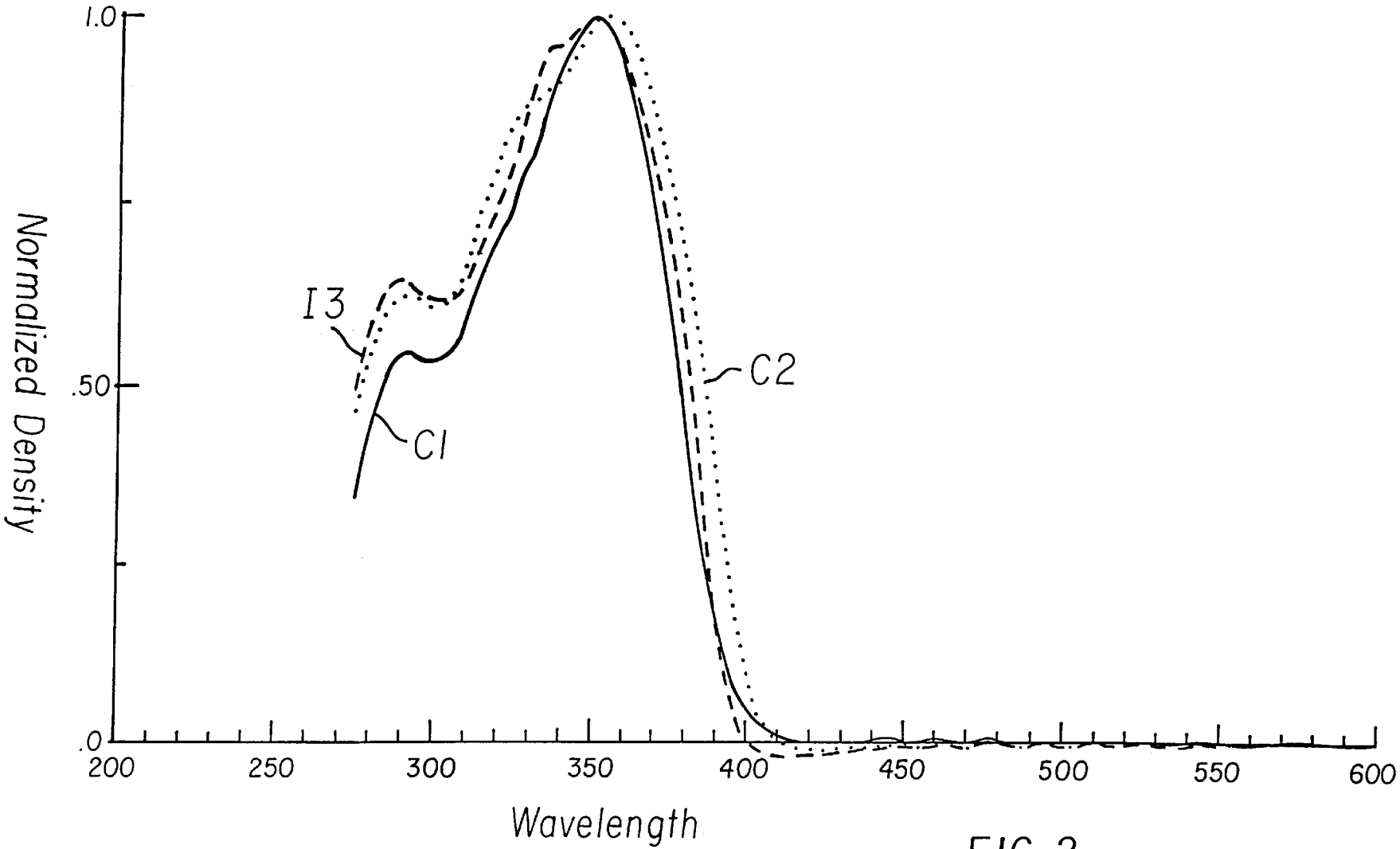
FIG. 2 shows the normalized absorption spectra of coatings in a photographic element for a mixture of comparative control compounds (II-A) and (II-B) (solid line, C-1), for a compound of formula (III) (dotted line, C-2), as well as for an invention compound (dashed line, I-3), in total transmission mode.
Figure 3:
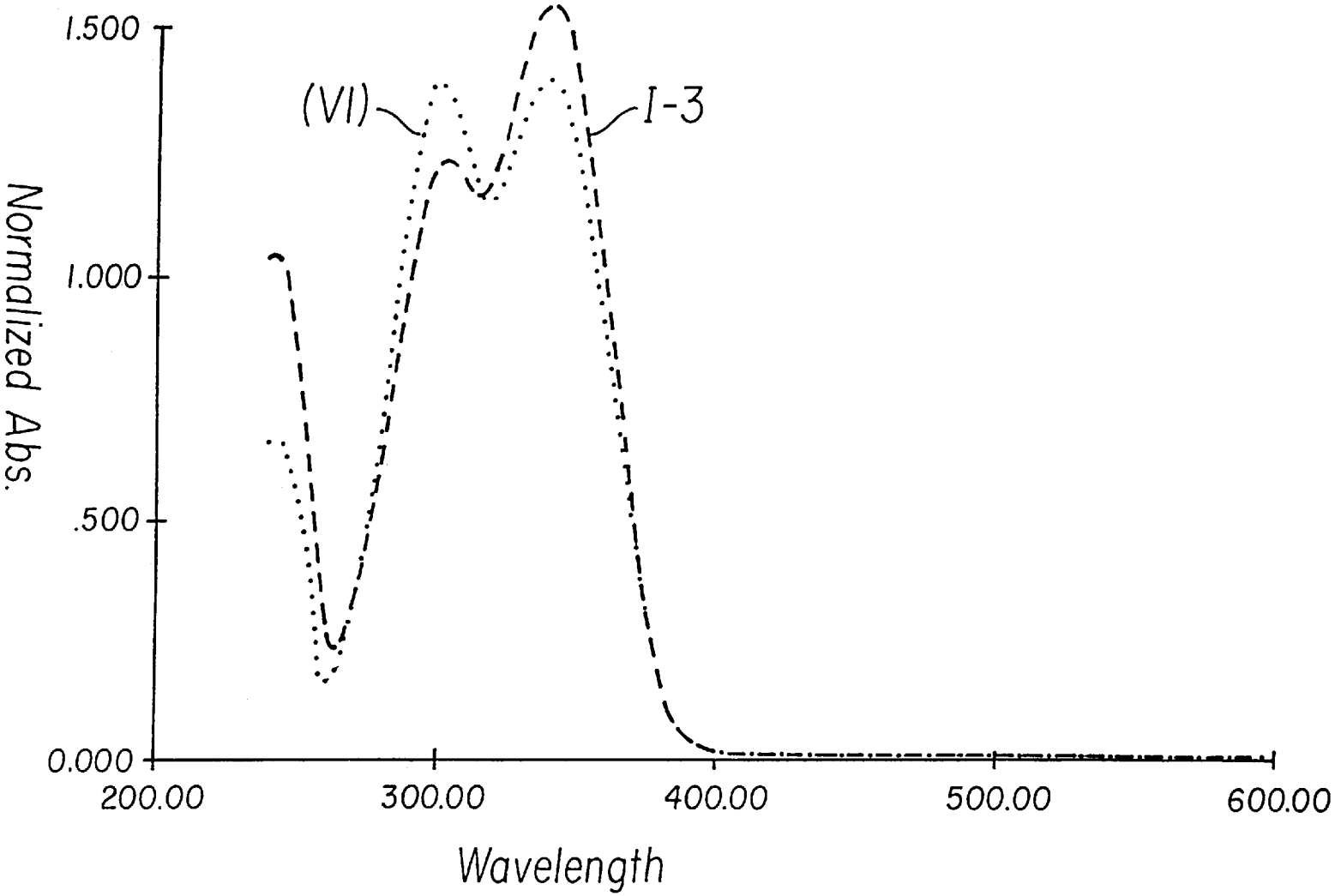
FIG. 3 shows the absorption spectra in methanolic solution for a prior art compound of Formula (VI) (dotted line) for an invention compound I-3 (dashed line) illustrating higher extinction and sharper drop-off for I-3 at the longer wavelength side.

Absorption spectra for various of the compounds were obtained in solution and in coating as described below and are shown in FIGS. 1, 2 & 3. In particular, FIG. 1 shows the normalized absorption spectra in methanolic solution for a mixture of comparative control compounds II-A and II-B (solid line) (Comparative Example C-1), prior art Comparative Example C-2 (dotted line), as well as for the compound of this invention such as I-3 (dashed line). FIG. 2 shows the normalized absorption spectra in coating in total transmission mode of the spectrophotometer for a mixture of comparative control compounds II-A and II-B (solid line) (Comparative Example C-1), prior art Comparative Example C-2 (dotted line), as well as for the compound of this invention such as I-3 (dashed line). Note from FIG. 1 that the inventive UV compound I-3 has about the same absorbance as comparative examples C-1 and C-2 in the important region of about 330–370 nm. Particularly, a bathochromic shift in C-2 contributes to its visible yellowing. However, the inventive compound I-3 has a steeper slope at its longer wavelengths of absorption (that is, near 380 nm) and particularly drops to a lower absorption at their longest wavelength of the absorption, than do the comparative examples C-1 and C-2. FIG. 2 representing the normalized absorption spectra of fresh coatings of their respective dispersions exhibits similar observation as FIG. 1.

FIG. 3 shows the absorption spectra in methanolic solution for a prior art compound of Formula (VI) (dotted line) and for an invention compound I-3 (dashed line) illustrating higher extinction and sharper drop-off for I-3 at the longer wavelength side. These two inherent characteristics are highly desirable for better performing UV absorbing compounds.

Microscopic observations for crystallinity in experimental UV absorber dispersions and coatings of these materials and their absorption spectra were performed as described here. Microscopy is undertaken in the preparation of dispersions of experimental materials in order to provide an initial indication of physical properties such as general particle size and stability (that is, tendency to crystallize). The microscopic particle size characterizations are performed using oil immersion optics ~1000x microscopy, and ~200x cross-polarized microscopy is used for crystal characterization. Microscopic evaluation of the coatings is also undertaken because an acceptable non-crystalline dispersion may recrystallize in the coated format. Assuming there are no re-crystallization problems, duplicate samples are spectrophotometrically measured using a Perkin-Elmer High Performance Lambda 4C spectrometer. These samples are then submitted for two Week HID and HIS light stability testing, and the post-testing spectra is measured and compared to the fresh measurements in order to determine intrinsic light stability of the UV absorber. Since the experimental dispersion formulation used for these experiments is common and only optimized from the standpoint of low melting solids and its beneficial effect on dispersion crystallinity, coated spectroscopy data are obtained primarily using the total transmission mode of operation where an integrating sphere is used in the spectrophotometer. This has the effect of diminishing light scattering effects due to particle size, so misleading extinction differences caused by light scattering in the specular mode can be overlooked.

A microscopic check for crystal formation from the above procedure, yielded the results in Table 4 below:

TABLE 4

Tendency to Form Undesirable Crystals

| Compound No. | Example No. | Dispersion | Coating |
|---|---|---|---|
| C-3 | 3 | Crystallized | Crystallized |
| C-4 | 4 | Crystallized | Crystallized |
| C-5 | 5 | Crystallized | Crystallized |
| C-6 | 6 | It did not crystallize | Crystallized |
| C-7 | 7 | Crystallized | Crystallized |
| C-8 | 8 | Crystallized | Crystallized |
| C-9 | 9 | It did not crystallize | It did not crystallize |
| I-2 | 11 | It did not crystallize | It did not crystallize |
| I-3 | 12 | It did not crystallize | It did not crystallize |
| I-4 | 13 | It did not crystallize | It did not crystallize |

Table 4 clearly illustrates that UV absorbing compounds such as C-3 through C-8 lacking asymmetric carbon atom center(s) are more prone to crystallization in dispersion and/or coatings. Interestingly, even though the examples C-6 and I-3 have identical number of atoms in the molecule (that is, these have the same molecular weight), only I-3 possessing an asymmetric carbon atom center passes the crystallinity test which approves the importance of asymmetric centers in the UV absorbing compounds of this invention.

Incidentally, whenever some UV absorbing compounds, such as example C-9, become an exception their intrinsic light stability often becomes somewhat inferior as will be illustrated in Table 5.

Intrinsic light stability data for UV absorbing compounds of this invention are summarized in Table 5. A combination of the compounds II-A & II-B has been used as a Control in each coating set and is referred to as C-1. The optical density loss, relative to the control coatings, was measured at 350 nm from coating spectral data.

TABLE 5

| | Light Stability | | | |
|---|---|---|---|---|
| Sample No. | 2 Week HID | 4 Week HID | 2 Week HIS | 4 Week HIS |
| Control Compounds II-A/II-B (C-1) | −6.50 | −15.92 | −5.87 | −10.08 |
| I-3 | −0.75 | −4.84 | 0 | −1.52 |
| I-4 | −0.13 | −3.64 | −2.14 | −1.04 |
| C-9 | — | −4.46 | — | — |

The intrinsic light stability data from Table 5 suggest that the UV absorbing compounds of this invention are better than the control comparative C-1. Further, the two-week stability data for C-9 and I-4 suggest that the presence of asymmetric carbon center seems to enhance intrinsic light stability of the UV absorbing compounds even though C-9 does not crystallize out, as shown in Table 4. This latter observation (that is, the effect of asymmetric carbon center) is further supported by the intrinsic light stability data in Table 6 for the prior art UV absorbing compounds of Formula (III) and Formula (VI) which incidentally contain asymmetric carbon center in the 5'-substituent. These were tested in a different coating set as illustrated in Table 6.

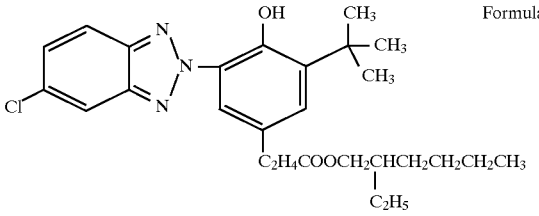

Formula (III)

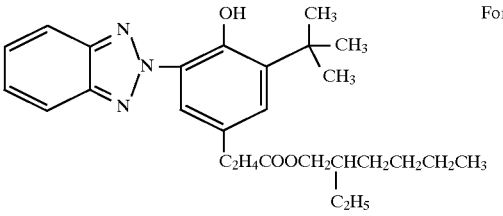

Formula (VI)

TABLE 6

| | Light Stability | | | |
|---|---|---|---|---|
| Sample No. | 2 Week HID | 4 Week HID | 2 Week HIS | 4 Week HIS |
| Control Compounds II-A/II-B (C-1) | −8.9 | −11.6 | −10.1 | −15.4 |
| Formula (III) C-2 | −3.3 | −4.1 | −0.8 | −4.7 |
| Formula (VI) | −3.4 | −8.8 | −2.5 | −8.1 |

The data in Table 6 clearly supports the importance of asymmetric carbon centers in the UV absorbing compounds. Although compounds of formula (III) and of formula (VI) offer better intrinsic light stability than the control C-1, neither one of them is superior to compounds of this invention for the reasons illustrated by FIGS. 1, 2 & 3, as discussed more fully above.

The present invention also specifically contemplates multilayer photographic elements as described in *Research Disclosure,* February 1995, Item 37038 (pages 79–115). Particularly contemplated is the use of any of the enantiomeric mixtures of formula (I) (particularly a 50/50 mixture of the two enantiomers) in such elements. Particularly, a 50/50 enantiomeric mixture of any one of the compounds in Tables A and B or Compounds V and VI, may be used as the UV absorbing compound in an overcoat of each of the photographic elements described in detail in Sections XVII through XXII of the *Research Disclosure* dated February 1995.

The preceding examples are set forth to illustrate specific embodiments of this invention and are not intended to limit the scope of the compositions or materials of the invention. It will be understood that variations and modifications can be effected within the spirit and scope of the invention.

We claim:

1. A photographic element comprising at least one light sensitive silver halide emulsion layer and an ultraviolet absorbing compound of the following structure:

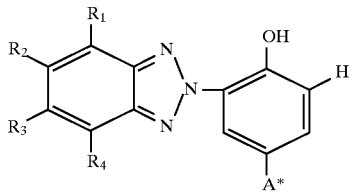

(I)

wherein:

each of $R_1$–$R_4$ independently is a hydrogen atom, halogen atom, a carbalkoxy group having at least one asymmetric carbon or asymmetric silicon atom, or an alkoxy group having at least one asymmetric carbon or asymmetric silicon atom, with the proviso that $R_2$ or $R_3$, or both $R_2$ and $R_3$ are other than hydrogen;

A* is a group having a carbon atom directly attached to 2'-hydroxyphenyl ring at the 5'-position and containing at least one asymmetric carbon atom or asymmetric silicon atom, and;

wherein the ultraviolet absorbing compound of formula (I) is a mixture of two enantiomers about the asymmetric carbon or asymmetric silicon of A*.

2. A photographic element according to claim 1 wherein the ultraviolet absorbing compound is a 60/40 to 40/60 mixture of two enantiomers.

3. A photographic element according to claim 1, wherein A* is an alkyl group having 4–14 carbon atoms and at least one asymmetric carbon atom or asymmetric carbon atom; or $$(CH_2)_p—G—R_5^*,$$

wherein:

$R_5^*$ is a branched or unbranched alkyl group having at least one asymmetric carbon atom or asymmetric silicon atom; p is 1 to 18; and G is —C(O)O—, —OC(O)—, —S—, —SO—, —$SO_2$— or —$CON(R)_6$—, where $R_6$ is a branched or unbranched alkyl, optionally containing an asymmetric carbon atom or asymmetric silicon atom.

4. A photographic element according to claim 1, wherein the ultraviolet absorbing compound is of the formula:

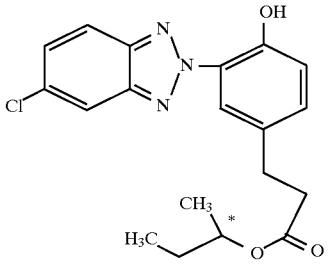

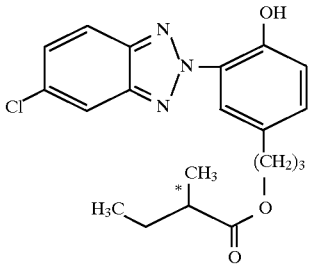

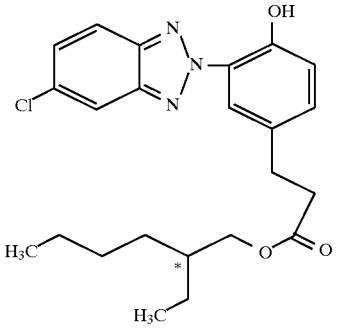

-continued or

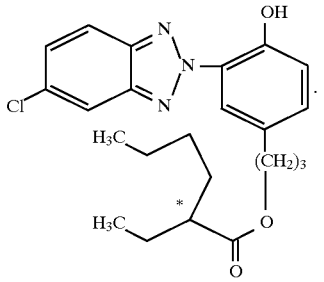

5. A photographic element according to claim 1, wherein A* comprises at least one asymmetric carbon atom and is further substituted with one or more groups attached to an asymmetric carbon atom of A*.

6. A photographic element according to claim 1, wherein at least one of $R_1$, $R_2$, $R_3$, $R_4$ is a halogen atom, an alkoxy group, or carbalkoxy group.

7. A photographic element according to claim 1, the element additionally comprising a non-light sensitive layer.

8. A photographic element according to claim 7, wherein the ultraviolet absorbing compound is located in the non-light sensitive layer.

9. A photographic element according to claim 7 wherein the non-light sensitive layer containing the ultraviolet absorbing compound is located above all light sensitive layers.

10. A photographic element according to claim 7, additionally comprising a reflective support and wherein the ultraviolet absorbing compound is located in the silver halide emulsion layer or in a layer positioned further from the support than the silver halide emulsion layer.

* * * * *